US005134558A

United States Patent [19]

Williams et al.

[11] Patent Number: 5,134,558

[45] Date of Patent: Jul. 28, 1992

[54] HAND HOLDABLE FLASHING LIGHT ASSEMBLY

[75] Inventors: Haleem A. Williams, Chula Vista; Philip M. Harris, San Diego, both of Calif.

[73] Assignee: Circle 3 Products, Inc., National City, Calif.

[21] Appl. No.: 523,858

[22] Filed: May 15, 1990

[51] Int. Cl.[5] ..... F21S 5/00

[52] U.S. Cl. ..... 362/263; 362/190; 362/200; 362/216; 362/293; 362/298; 362/346

[58] Field of Search ..... 362/216, 263, 293, 367, 362/190, 200, 298, 346, 347

[56] References Cited

U.S. PATENT DOCUMENTS

| | | | |
|---|---|---|---|
| 3,731,082 | 5/1973 | Blaylock | 362/263 |
| 3,833,828 | 9/1974 | Vivari | 362/263 X |
| 4,079,243 | 3/1978 | Pemberton | 362/200 X |
| 4,296,460 | 10/1981 | Minoprio et al. | 362/200 |
| 4,482,941 | 11/1984 | Lindner | 362/200 X |
| 4,638,410 | 1/1987 | Barker | 362/267 X |
| 4,931,766 | 6/1990 | Bernard et al. | 362/263 X |

FOREIGN PATENT DOCUMENTS

| | | | |
|---|---|---|---|
| 565144 | 10/1958 | Canada | 362/216 |

*Primary Examiner*—Ira S. Lazarus
*Assistant Examiner*—Peggy Neils
*Attorney, Agent, or Firm*—Edgar W. Averill, Jr.

[57] ABSTRACT

A hand holdable flashing light assembly. Preferably, the assembly has a xenon bulb which is held in a case and which is powered by a battery and controlled through a circuit which provides a periodic charge through the xenon bulb. The case preferably has a lens on both sides, which lenses may be of different colors. The light can be easily held in the palm of the hand, and by turning the light around, a different color may be provided on one side as compared to the other side.

5 Claims, 2 Drawing Sheets

30
29
10
13
14
11

100
SW1
Push-ON, Push-OFF
29
34
BT1
1.5V
35
BT2
1.5V
36
BT3
1.5V
37
BT4
1.5V
105
106
CR1
1N4148
108
111
110
115
T1
CR2
1N4005
Q1
TIP 32
104
113
114
R1
47K
C1
.001
C2
22
35V
113
102
103
112
OSC X-Former
C3
100
10V
117
C4
0.1
1N4148-1
CR3
120
124
132
135
18
17
FT1
19
20
123
R5
2M
C7
0.047
400V
131
136
116
R4
100K
U1
TLC555
DIS
VCC
R
CV
THR
TR
GND
Q
5 NC
R3
10M
122
140
TRIG X-FORMER
130
T2
TG
Flash Tube
138
125
127
C6
.001
R4
10K
Q2
EC1030
132
134
21
C5
0.15
10V
119
136
128
126

HAND HOLDABLE FLASHING LIGHT ASSEMBLY

BACKGROUND OF THE INVENTION

The field of the invention is lighting devices, and the invention relates more particularly to safety and locating lamps.

Flashing lights are widely used to control vehicular traffic. Highway flashers are typically provided with large storage batteries and a bulb which is intermittently energized. Such devices are not typically appropriate to be hand held because of the weight of the storage battery and the configuration of the lighting assembly.

Xenon bulbs are widely used to provide intense, extremely short flashes of light for uses as high speed photography. They are also used to provide very bright light beams for photography or for search lights. These uses require a large amount of power. When a charge of electricity is passed through xenon gas at low pressure, it emits a flash of bluish white light and at higher pressures, a white light resembling daylight is emitted which is particularly useful for photography.

For applications such as rescue, it would be highly desirable to provide the person being searched for with a light source that could be seen for many miles. For uses such as backpacking or for military maneuvers, it would not be practical to carry the standard storage battery-powered type of flasher. However, if someone were lost in the mountains or at sea, the ability to provide periodic flashes of a bulb such as a xenon bulb could make the difference between success and failure of a rescue operation.

For traffic guidance, it is beneficial to alternatively provide a red light, a green light or an amber light depending upon the desired flow of traffic. While the common approach is a pair of bulbs, each behind a different colored lens, such fixtures are inherently not sufficiently compact to be held easily by hand.

BRIEF SUMMARY OF THE INVENTION

It is an object of the present invention to provide a hand holdable flashing light assembly which is capable of providing an intensely bright flashing light while being powered by relatively small flashlight batteries.

It is another object of the present invention to provide a flashing light assembly which has a lens at each end thereof so that different colors may be shown by turning the lighting assembly in the opposite direction.

The present invention is for a hand holdable flashing light assembly comprising a case including mounting means. Battery means are held by the mounting means within the case, and means for supplying appropriate current and voltage are also held by the mounting means. A xenon bulb is held within the case, and a switch having an on and off position is also held by the case. A circuit is provided for periodically passing a charge of electricity through the xenon bulb when the switch is in an on position, and at least one lens is mounted over a portion of the case. Preferably, a lens is provided over both ends of the case, and the bulb is mounted so that it may be viewed through either end. Preferably, the bulb is a generally U-shaped xenon bulb which has first and second legs which are mounted generally aligned with the central axis of the case. In this way, one of the legs of the xenon bulb is closer to one lens, and the other end is closer to the second lens. Also, preferably, the switch and the lens are waterproof so that the light can be used under water. The assembly may be powered by only four AA size batteries which have been found to provide up to ten hours of continuous use. The assembly is sufficiently light and compact to be easily carried by campers and military personnel as part of a rescue pack.

DESCRIPTION OF THE PREFERRED EMBODIMENT

Figure 1:
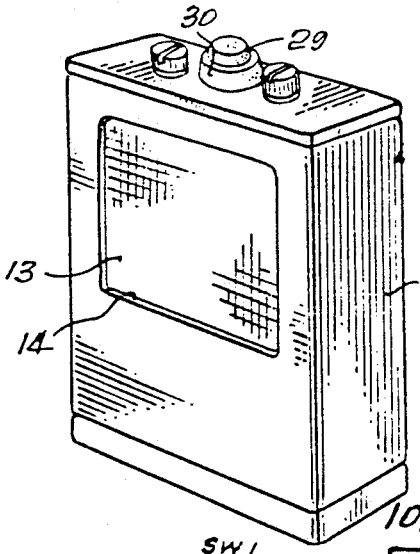
FIG. 1 is a perspective view of the hand holdable flashing light assembly of the present invention.
Figure 2:
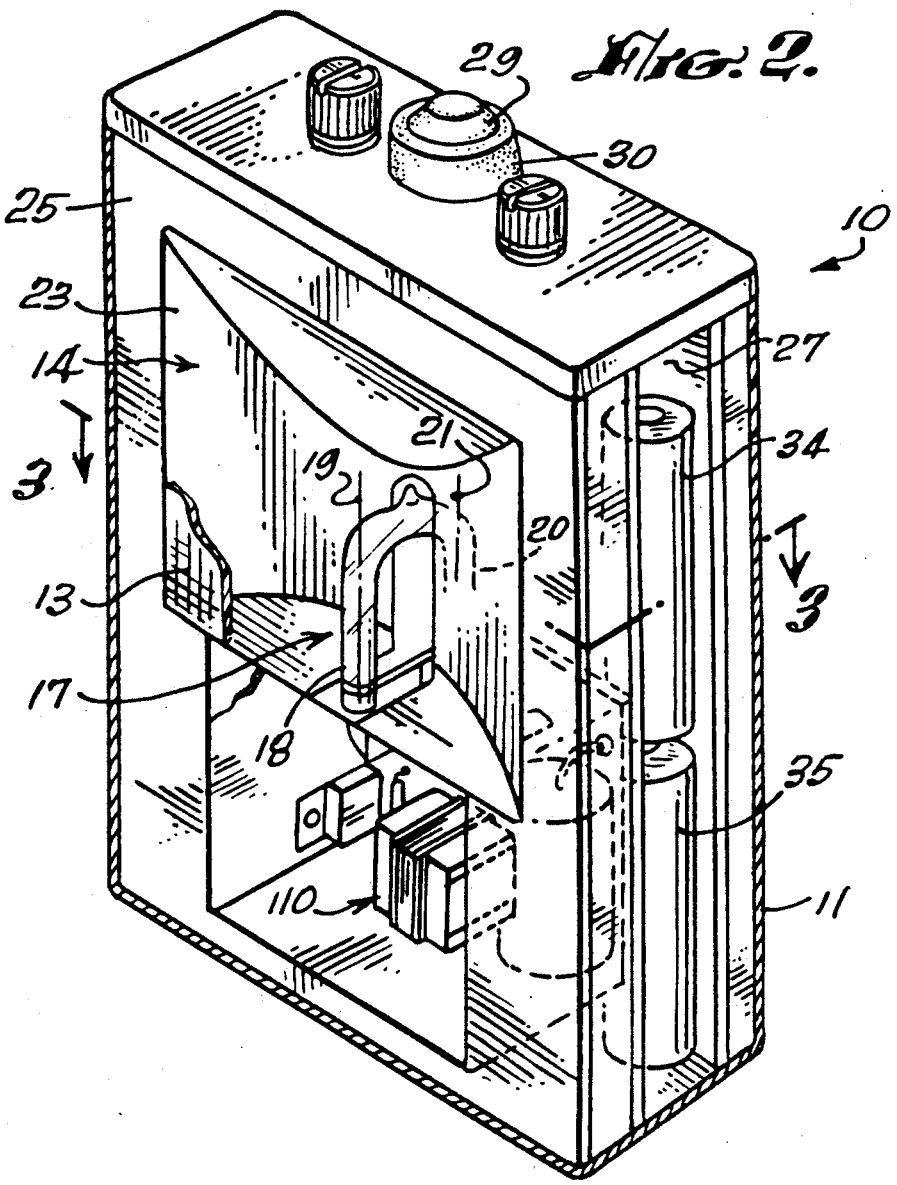
FIG. 2 is an enlarged perspective view of the hand holdable flashing light assembly of FIG. 1.

A hand holdable flashing light assembly is shown in perspective view in FIG. 1 and indicated by reference character 10. Assembly 10 has a generally rectangular case 11 which may be easily held in the user's hand. The assembly also has a first lens 13 which is affixed over an area 14 of the case 11 as shown best in FIG. 2.

Figure 3:
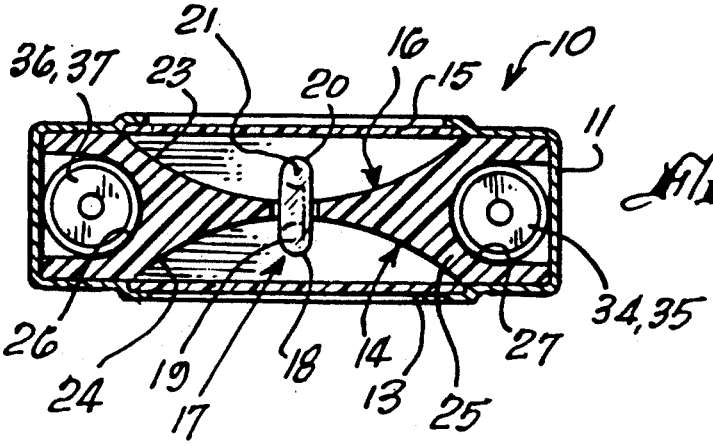
FIG. 3 is a cross-sectional view taken along line 3—3 of FIG. 2.

As shown in FIG. 3, hand holdable flashing light assembly 10 has a second lens 15 which is affixed over a second area 16 on the other side of case 11. A xenon bulb 17 is generally U-shaped and has a first leg 18 which has a first central axis 19 and a second leg 20 which also has a second central axis 21.

Xenon bulb 17 is preferably supported by its conductors. A pair of reflectors 23 and 24 are molded in a frame 25. Frame 25 also has two elongated open grooves 26 and 27 which hold four batteries 34, 35, 36 and 37. Preferably, grooves 26 and 7 are on opposite sides of the case to provide optimum balance.

A switch 29 is mounted in the top of case 11 and is preferably a pushbutton switch which is mounted in a waterproof boot 30.

Because of the shape of the assembly, it is easily held by hand. The mounting means held within the case provides both balance and a compact assemblage of the circuit elements. It has been found that AA batteries when provided with the circuitry described below are capable of firing a xenon bulb and providing an intensely bright flash at each time and may be operated for up to about ten continuous hours.

Figure 4:
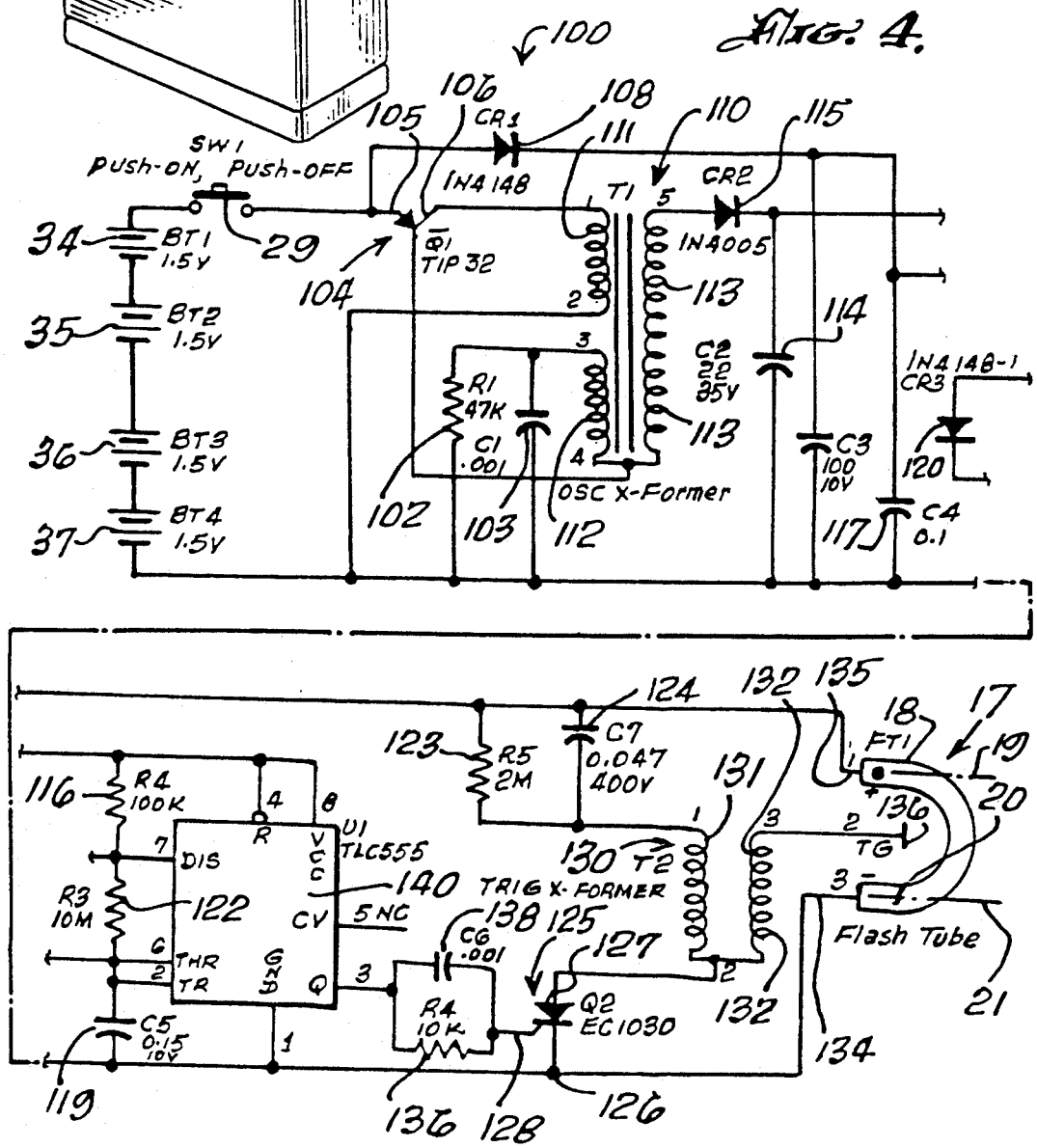
FIG. 4 is a circuit diagram of the hand holdable flashing light assembly of FIG. 1.

The circuit diagram is shown in FIG. 4 where batteries 34, 35, 36 and 37 can be seen to be mounted in series to provide six volts.

FIG. 4 sets forth a circuit diagram of the electronic portion of the present invention generally referenced by reference numeral 100. A quartet of batteries 34, 35, 36, and 37 are serially arranged to provide a DC power source for circuit 100. A push-on and push-off switch 29 is placed between the negative terminal of battery 34 and the positive terminal of battery 37. A transformer 110 includes a primary winding 111, feedback winding 112 and a secondary winding 113. Primary winding 111 is coupled to ground on one end and the collector terminal 106 of PNP transistor 104 on the other end. Feedback winding 112 is connected to the base electrode 106 of transistor 104 and to ground via resistor 102 in parallel with capacitor 103. Transistor 104 emitter 105 is tied to the positive terminal of battery 34.

An integrated circuit 140 having a standard device number TLC555 is configured to provide a series of pulse signals at a predetermined frequency. For convenience, both the standard device terminal numbers and the designations of the terminals are indicated in FIG. 4. Integrated circuit 140 includes a ground terminal labeled "GND" connected to ground. A trigger terminal labeled "TR," which bears the pin number 2, is coupled to ground by a capacitor 119. A threshold terminal labeled "THR" having a pin number 6 is coupled to pin 2. A discharge terminal labeled "DIS" has pin number 7 and a reset terminal has a pin number 4. An operating supply terminal labeled "VCC" has a pin number 8. An output terminal has a pin number 3, and pin number 5, labeled "CV," is not connected. A resistor 122 and a diode 120 are coupled between the DIS and THR terminals of integrated circuit 140. A resistor 116 is serially coupled between the "VCC" and "DIS" terminals. Diode 108 provides power to the "VCC" terminal of integrated circuit 140, and capacitor 117 is coupled between said terminal and ground.

A silicon controlled rectifier (SCR) 125 includes a cathode electrode 126, and anode electrode 127 and a gate electrode 128 which is coupled to integrated circuit 140 via resistor 136 and capacitor 138. A trigger transformer 130 includes a primary winding 131 and a secondary winding 132 commonly coupled to the anode 127 of SCR 125. The remaining end of primary winding 131 is coupled to capacitor 114 through resistor 123 and capacitor 124. A xenon bulb 17 includes a pair of electrodes 134 and 135 and a trigger electrode 136. Trigger electrode 136 is coupled to the remaining end of secondary winding 132. Electrode 134 of xenon bulb 17 is coupled to ground while terminal 135 of xenon bulb 17 is coupled to the junction of capacitor 114 and diode 108.

In operation, the DC power, provided by the serial arrangement of batteries 34 through 37, coupled by switch 29 to the oscillator circuit formed by transistor 104, diode 108, resistor 102, capacitor 103, primary winding 111 and feedback winding 112 of transformer 110. In accordance with conventional oscillator operation, transistor 104 provides a free running oscillator producing a time varying signal which produces a corresponding time varying magnetic flux in transformer 110 which, in turn, induces a corresponding voltage in secondary winding 113. Because of the increased number of turns in secondary winding 113, the amplitude of signal produced a secondary winding 113 is substantially greater than that in primary winding 111 (330V versus 6V). The combination of diode 115 and capacitor 114 converts the time varying signal in secondary winding 113 to a single polarity or DC voltage. The DC voltage appears across capacitor 114 and is applied to terminals 134 and 135 of xenon bulb 17. Xenon bulb 17 requires both the DC power at terminals 134 and 135 and a triggering pulse at trigger electrode 136 to produce illumination.

Integrated circuit 140 is configured to produce a free running pulse generator which produces a series of periodic pulse signals (once a second) at gate 128 of SCR 125 to produce a larger input pulse driving primary winding 131 of transformer 130. The coupling between primary and secondary windings of transformer 130 causes transformer 130 to produce a high amplitude voltage pulse (4000V) each time a pulse is applied to primary winding 131. Correspondingly, each high amplitude voltage pulse at secondary winding 132 is applied to trigger electrode 136 of xenon bulb 17 causing the xenon bulb to fire.

Thus, the circuit shown in FIG. 4 provides the DC poser as well as triggering signals required to continuously flash xenon bulb 17 so long as switch 29 is on. With switch 29 open, the power supply to xenon bulb 17 is interrupted and xenon bulb 17 ceases to flash.

The lenses of the hand holdable assembly of the present invention may be provided with different colors. For instance, lens 13 could be red and lens 15 green. In this way, the device could be easily held in a manner to direct traffic. Further light focusing can be provided by a Fresnel lens.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A hand holdable flashing light assembly comprising:

a case including a mounting frame;

battery means held by said mounting frame;

a generally U-shaped xenon bulb having a first leg and a second leg, said first leg has a first central axis, and said second leg has a second central axis and wherein said mounting frame has a pair of opposed reflecting surfaces, each of which have an opening near the center thereof, and said generally U-shaped bulb having its first leg within one of said reflecting surfaces and its second leg within the second of its reflecting surfaces;

switch means having an on position and an off position;

circuit means for periodically passing a charge of electricity through said xenon bulb when said switch means is in an on position; and at least two lens means held by said case.

2. The hand holdable flashing light assembly of claim 1 wherein the first of said lenses is red, and the second of said lenses is green.

3. A hand holdable flashing light assembly comprising:

a generally rectangular case having a first side and a second side, said case including a mounting frame, said case having a length and a width, a top and two sides;

two lens means affixed over each of said first and second sides;

battery means held by said mounting frame:

a generally U-shaped xenon bulb held by said mounting frame, said U-shaped xenon bulb having a first leg near said first side and a second leg near said second side;

reflector means supported by said case, said reflector means comprising first and second opposed reflecting surfaces, each of said reflecting surfaces having a central opening and said first reflecting surface being positioned to reflect the light from the first leg of said xenon bulb and the second reflecting surface being positioned to reflect the light of the second leg of said xenon bulb;

switch means having an on position and an off position, said switch means being held by said case; and circuit means for periodically passing a charge of electricity through said xenon bulb when said switch means is in an on position.

4. The hand holdable flashing light assembly of claim 3 wherein said switch means waterproof switch.

5. The hand holdable flashing light assembly of claim 3 wherein said battery means comprises four dry cell batteries mounted in two pairs, one pair being mounted near one side of the case, and a second pair being mounted near the opposite side of the case.

* * * * *